United States Patent [19]

Laforest Le Boudec

[11] Patent Number: 4,509,916

[45] Date of Patent: Apr. 9, 1985

[54] DEVICES FOR PRODUCING IGNITION SPARKS WHEN FALLING ON A PYROPHORIC FLINT

[75] Inventor: Guy Laforest Le Boudec, Barcelona, Spain

[73] Assignee: Laforest, S.A., Barcelona, Spain

[21] Appl. No.: 570,026

[22] Filed: Jan. 11, 1984

[30] Foreign Application Priority Data

Mar. 11, 1983 [ES] Spain ..... 520.550

[51] Int. Cl.[3] ..... F23Q 1/02

[52] U.S. Cl. ..... 431/273

[58] Field of Search ..... 431/267, 273, 274, 276, 431/277

[56] References Cited

U.S. PATENT DOCUMENTS 3,910,751 10/1975 Chernock ..... 431/273

3,910,752 10/1975 Holl ..... 431/273

*Primary Examiner*—Carroll B. Dority, Jr.

*Attorney, Agent, or Firm*—Wenderoth, Lind & Ponack

[57] ABSTRACT

A device for producing ignition sparks when falling on a pyrophoric flint includes a coil spring having at least one coil which is provided with a pit in a transversal or inclined direction on the outer longitudinal line of the coil. The pit is formed of "saw-teeth" type projections which protrude from the original core of the coil, thereby forming on the outer surface of the coil spring cutting projections which, when falling on a pyrophoric flint applied to the outside of the coil spring and when the coil spring turns about its axis, produce a tangential hauling of the pyrophoric flint thereby emitting an ignition spark.

1 Claim, 5 Drawing Figures

DEVICES FOR PRODUCING IGNITION SPARKS WHEN FALLING ON A PYROPHORIC FLINT

The present invention refers to a device for producing an ignition spark when same acts on a pyrophoric flint incorporated in the frame thereof.

The more direct application of the system of the present invention resides in the production of lighters, although it can be applied to any branch of the industry where a spark should be emitted at a determined point of its structure.

Based on this main application, the conventional technique produces the ignition spark of a lighter when the rough outer surface of a cylinder is made to fall upon a flint housed in a frame, exerting a tangential pressure on two parallel wheels which are secured thereto and producing a friction on the flint which generates the spark.

Additional costs are not only involved inasmuch as this rough surface with which the cylinder is provided and the manufacture of the cylinder itself should be subject to a machining process and a subsequent treatment, apart from the material wasted in the making of the cylinder itself and in the machining of the central bore, but the costs are highly elevated due to the production of the helicoidal chip breaker and of the pitting of the teeth according to the generators thereof, as well as the subsequent treatment of these pieces.

Although the first step is carried out, as conventionally, using automatic multispindle lathes, wherein the cylinder is completely manufactured, the steps of chip breaking in some cases, and pitting, stamping and annealing in others, as well as cutting and bevelling in other embodiments, and a subsequent treatment of the finished piece, should be carried out using different machines, wherefore the hand labour is increased and the acquisition and conservation of the high number of machines, necessary to supply present day demands of the market, become excessive.

With the present invention the production costs of this piece are highly reduced since said piece is not incorporated thereto but it is replaced by an element constituting the object of the invention and which is the following:

The object of the invention is characterised in that it comprises a coil spring, the coils of which are in contact with the following, provided with a saw-tooth type of pitting made transversally along the outer circumference thereof, which is provided with two lateral wheels fitting into one another by indented necks which penetrate therein and are fixed thereto in circular housings made on the inner face thereof in prolongation of the outer surface of the neck, which are provided with a front projection against which there butts each outer projection of the spring, while it is also fixed since it enters by pressure in the circular housing and the crests of the pitting of the spring are tightened to the outer surface thereof.

It can be understood from the characteristics of the spring, object of this invention, that the mass production costs are lower than that of the conventional system since, departing from the coiled thread which has been subjected to a pitting step along a transverse line of the complete thread and its coiled winding, and the cutting thereof, it is sufficient to subject them to a second and final step of heat treatment to complete the manufacture thereof.

For a better understanding of this specification, there is accompanied to the specification forming an integral part thereof, a set of drawings, wherein illustratively and not limiting, there is represented:

Figure 1:
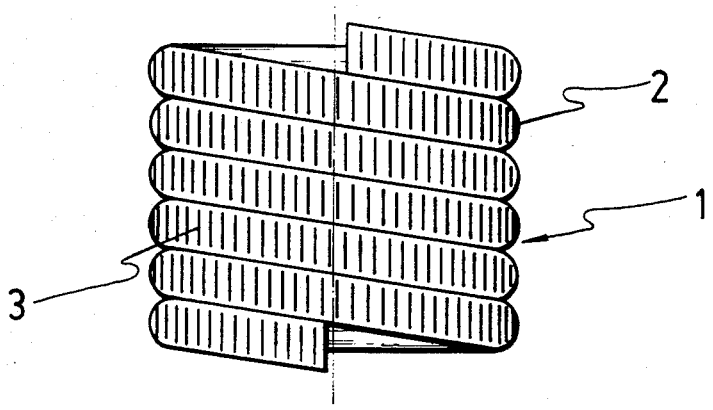
FIG. 1 is an elevational view of the object of the invention.
Figure 2:
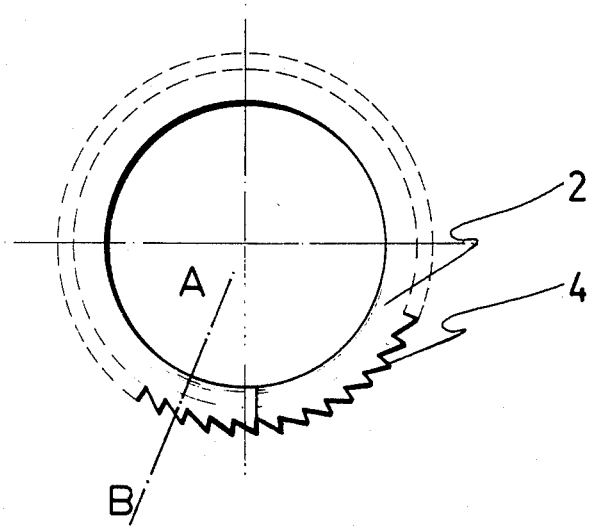
FIG. 2 is a plan view of the object of the invention.
Figure 3:
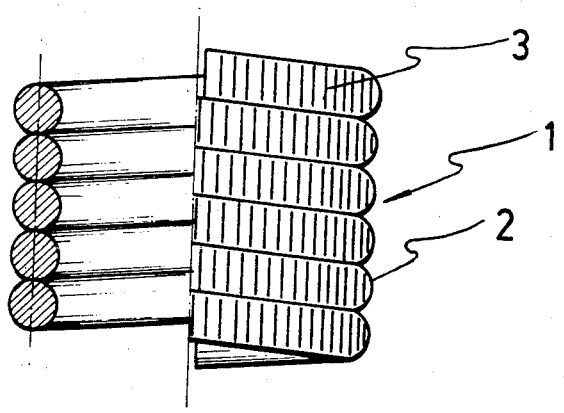
FIG. 3 is a cut elevational view of the object of the invention.
Figure 4:
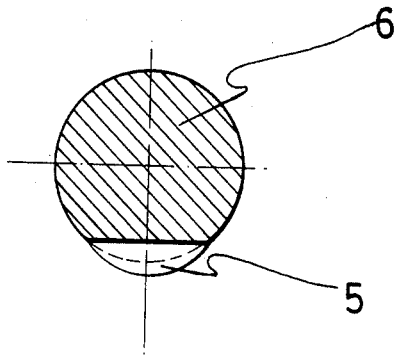
FIG. 4 is a cross-section of a coil taken along line A-B of FIG. 2.

Referring to the aforementioned figures, it can be seen that the object of the invention is comprised of a spring 1 having contacting coils 2, which is provided with the peripheric longitudinal pitting 3 transversally made on the outer line of the coil, this pitting having the form of a saw tooth 4 forming a projection 5 protruding from the original core 6 of the coil 2.

Figure 5:
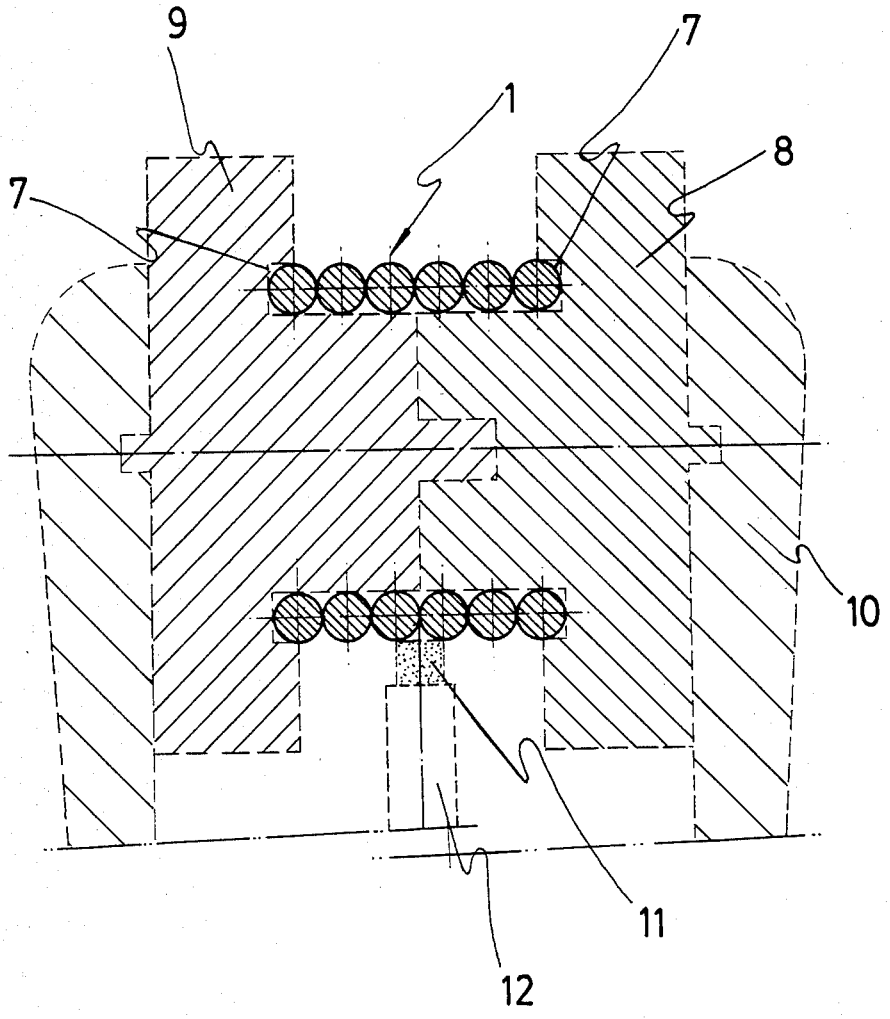
FIG. 5 is a longitudinal section of the object of the invention coupled to the frame of a lighter which constitutes the most direct application thereof.

Based on the fact that the direct and main application of the object of the invention resides in its incorporation in a lighter, as can be seen in FIG. 5, the spring 1 is securely fixed when housed in the circular recesses 7 made in the wheels 8 and 9, which are rotatably fixed to the frame 10 which incorporates the pyrophoric flint 11 guided in the circular conduct 12 and applied to the corresponding generator of the spring 1, so that when the wheels turn manually, the ignition spark is produced.

I claim:

1. Improvements in devices for producing ignition sparks when falling on a pyrophoric flint, essentially characterised by a coil spring having one or various coils, which is provided with a pitting in a transversal or inclined direction made on the outer longitudinal line of the coils thereof, said pitting being formed of "saw-teeth" type projections which protrude from the original core of the coil, thereby forming on the outer surface of the coil spring cutting projections which, when falling on a pyrophoric flint applied to the outside of the coil spring and when said coil spring turns about its axis, produce a tangential hauling of the pyrophoric flint thereby emitting the ignition spark.

* * * * *

US004509916B1

REEXAMINATION CERTIFICATE (2181st)

United States Patent [19]

[11] B1 4,509,916

Laforest Le Boudec

[45] Certificate Issued Jan. 11, 1994

[54] DEVICES FOR PRODUCING IGNITION SPARKS WHEN FALLING ON A PYROPHORIC FLINT

[75] Inventor: Guy Laforest Le Boudec, Barcelona, Spain

[73] Assignee: Bic Corporation, Milford, Conn.

Reexamination Request:
No. 90/002,919, Jan. 4, 1993

Reexamination Certificate for:

| | |
|---|---|
| Patent No.: | **4,509,916** |
| Issued: | **Apr. 9, 1985** |
| Appl. No.: | **570,026** |
| Filed: | **Jan. 11, 1984** |

[30] Foreign Application Priority Data

Mar. 11, 1983 [ES] Spain ..... 520.550

[51] Int. Cl.[5] ..... F23Q 1/02
[52] U.S. Cl. ..... 431/273
[58] Field of Search ..... 431/267, 273, 274, 276, 431/277

[56] References Cited

U.S. PATENT DOCUMENTS

| | | | |
|---|---|---|---|
| 2,455,348 | 12/1948 | Barstow | 76/101 |
| 2,779,179 | 1/1957 | Smith | 67/7.1 |
| 3,010,856 | 11/1961 | Seelig et al. | 148/6 |
| 3,594,108 | 7/1971 | Villarreal-Cueva | 431/254 |
| 3,910,751 | 10/1975 | Chernock | 431/273 |
| 3,910,752 | 10/1975 | Holl | 431/273 |

FOREIGN PATENT DOCUMENTS

| | | | |
|---|---|---|---|
| 6-3956 | 4/1931 | Japan . | |
| 37-16086 | 7/1962 | Japan . | |
| 54-31370 | 3/1979 | Japan | F23Q 2/46 |

OTHER PUBLICATIONS

English Translation of Document "L" Furnished by Reexam Requester, 4 pages.

*Primary Examiner*—Carroll B. Dority

[57] ABSTRACT

A device for producing ignition sparks when falling on a pyrophoric flint includes a coil spring having at least one coil which is provided with a pit in a transversal or inclined direction on the outer longitudinal line of the coil. The pit is formed of "saw-teeth" type projections which protrude from the original core of the coil, thereby forming on the outer surface of the coil spring cutting projections which, when falling on a pyrophoric flint applied to the outside of the coil spring and when the coil spring turns about its axis, produce a tangential hauling of the pyrophoric flint thereby emitting an ignition spark.

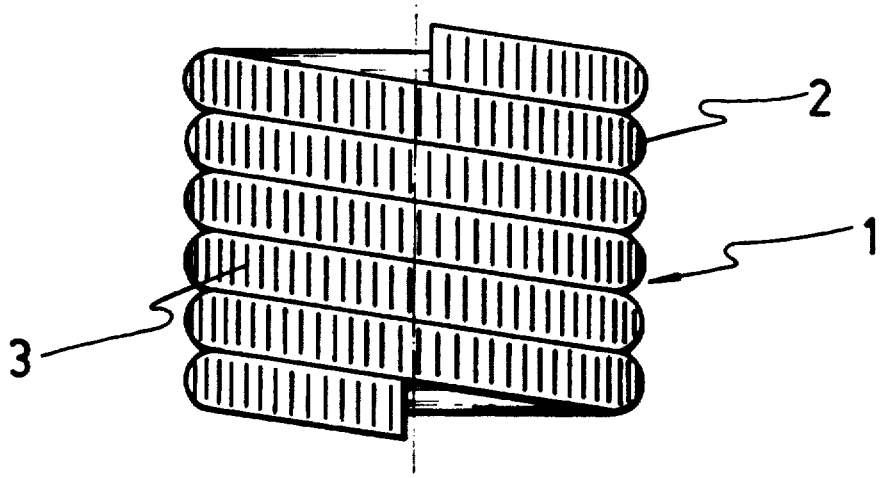

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 1 is confirmed.

New claim 2 is added and determined to be patentable.

*2. An improved device for producing ignition sparks when falling on a pyrophoric flint, essentially characterized by a coil spring having an original core, at least one coil and a plurality of cutting projections, wherein said coil spring is made from a coil thread which has been subjected to a pitting step to form a pitting in a transversal or inclined direction on the outer longitudinal line of the coil threads, said pitting being formed of "saw teeth" type projections which protrude from said original core of said coil spring, thereby forming on the outer surface of the coil spring said cutting projections which, when falling on a pyrophoric flint applied to the outside of the coil spring and when said coil spring turns about its axis, produce a tangential hauling of the pyrophoric flint thereby emitting the ignition spark.*

* * * * *